United States Patent [19]

Hagemeister

[11] Patent Number: 4,838,528

[45] **Date of Patent: * Jun. 13, 1989**

[54] BENT WIRE SPRING MODULE

[75] Inventor: Robert C. Hagemeister, Boston, Mass.

[73] Assignee: Webster Spring Co. Inc., Oxford, Mass.

[ * ] Notice: The portion of the term of this patent subsequent to Aug. 11, 2004 has been disclaimed.

[21] Appl. No.: 179,208

[22] Filed: Apr. 4, 1988

[51] Int. Cl.[4] ..... A47C 23/02

[52] U.S. Cl. ..... 267/103; 5/255

[58] Field of Search ..... 5/247, 255, 267; 267/103, 106, 107, 110

[56] References Cited

U.S. PATENT DOCUMENTS 4,666,136 5/1987 Hagemeister ..... 267/103

4,685,659 8/1987 Hagemeister ..... 267/103

*Primary Examiner*—Duane A. Reger

*Attorney, Agent, or Firm*—R. T. Gammons

[57] ABSTRACT

A spring module for disposition between a supporting frame and a grid frame to yieldably support the latter relative to the supporting frame, comprising spaced, parallel top and bottom attaching elements and spaced supports disposed between and attached to the top and bottom attaching elements embodying vertically-disposed and inclined lengths of wire disposed symmetrically about the vertical axis of the module.

21 Claims, 2 Drawing Sheets

BENT WIRE SPRING MODULE

BACKGROUND OF THE INVENTION

In my pending application, Ser. No. 760,253, now U.S. Pat. No. 4,666,136, filed July 29, 1985, there is shown and claimed a spring module wherein there are upper and lower attaching elements for connecting the units to a support frame and a grid frame and wherein there are spaced, parallel, vertically-disposed legs yieldable in spaced, parallel, perpendicular planes. Because the legs are diametrically opposite, yield is asymmetrical. It is the purpose of this invention to provide a structure wherein the supporting legs are so disposed as to provide symmetrical yielded about the perpendicular axis of the module.

SUMMARY OF THE INVENTION

In accordance with the invention, the spring module as herein illustrated for disposition between a supporting frame and a grid frame to yieldably support the latter relative to the supporting frame comprises top and bottom attaching means structured to be attached to the grid and support frames, respectively, and yieldable supporting means disposed between the attaching means, comprising vertically-disposed, spaced, parallel lengths of wire, first diverging lengths of wire connected at one end to the upper and lower ends of said vertically-spaced, parallel lengths of wire, second diverging lengths of wire connected at one end to the opposite ends of the first diverging lengths of wire and extending from said opposite ends in opposite directions and connected at their upper and lower ends to the top and bottom attaching elements, said second diverging lengths of wire being inclined in opposite directions. The first diverging lengths of wire are disposed at obtuse angles with respect to the ends of said vertically-spaced, parallel lengths of wire and the second diverging lengths of wire are disposed at obtuse angles with respect to the first diverging lengths of wire. The second diverging lengths of wire are disposed in a plane which is obtuse to the plane of the first diverging lengths of wire.

The invention will now be described in greater detail with reference to the accompanying drawings, wherein.

Figure 1:
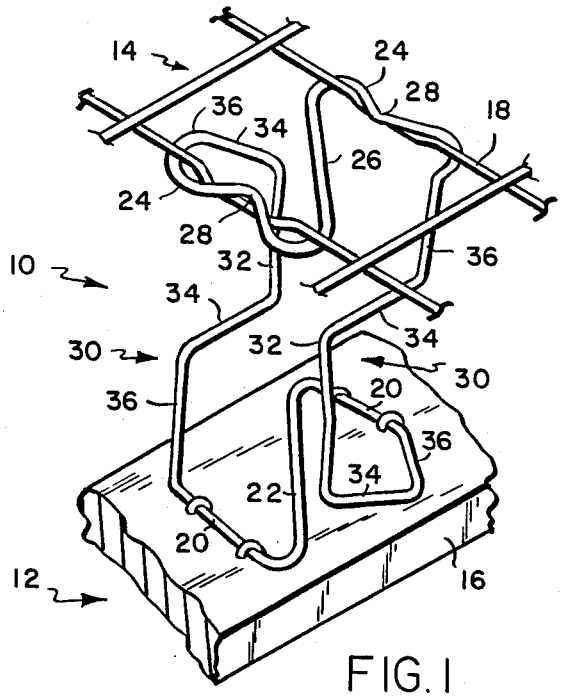
FIG. 1 is a perspective view of a spring module constructed according to the invention disposed between a base frame and a grid frame, only portions of which are shown.
Figure 2:
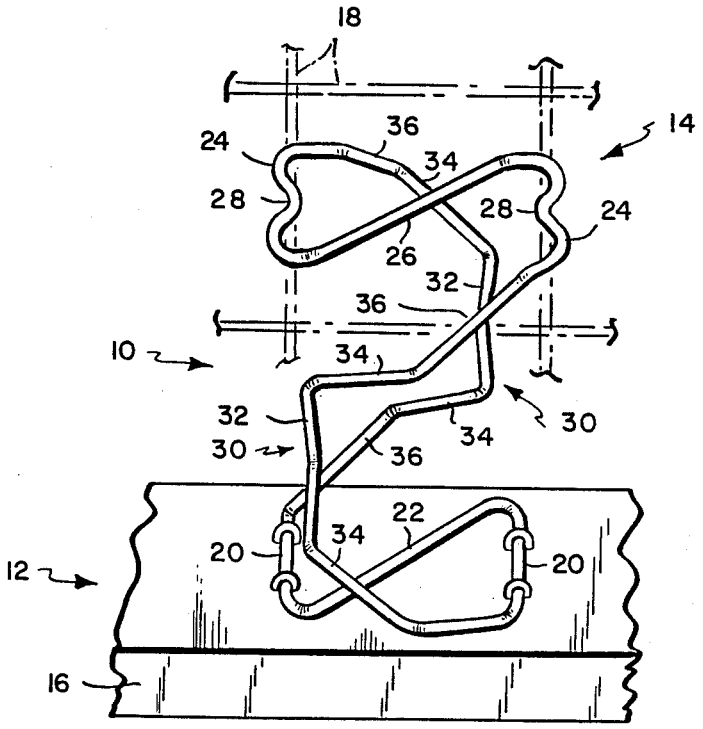
FIG. 2 is a perspective view of the spring module shown in FIG. 1 taken on the line 2—2 of FIG. 1.

Referring to the figures, FIGS. 1 and 2, there is shown a spring module 10 constructed according to this invention disposed between a base frame 12 and a grid frame 14 with its lower end stapled to the crossbars 16 of the base frame and its upper end connected to the crossing wires 18 of the grid frame. The lower end of the module 10 comprises spaced, parallel lengths of wire 20—20 connected by a diagonal length of wire 22 and the upper end comprises spaced, parallel lengths of wire 24—24 connected by a diagonal length of wire 26. The upper lengths of wire 24—24 contain deviations 28—28. The lengths of the wires 20—20 and the lengths of the wires 24—24 comprise attaching elements by means of which the module is connected to, respectively, the base frame and the grid frame.

Figure 3:
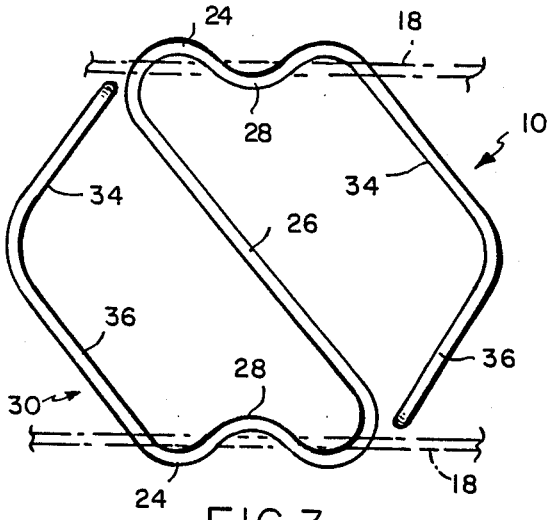
FIG. 3 is a top plan view.
Figure 6:
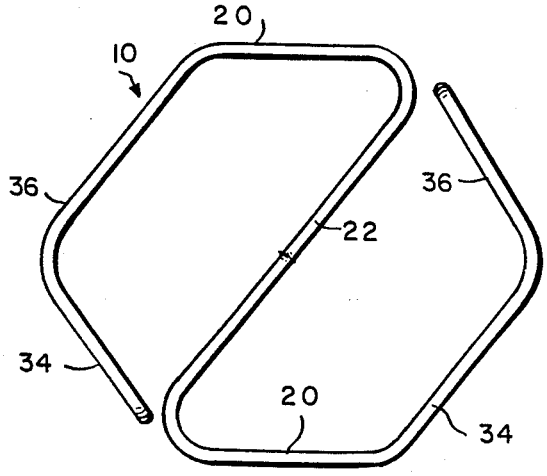
FIG. 6 is a bottom plan view.
Figure 4:
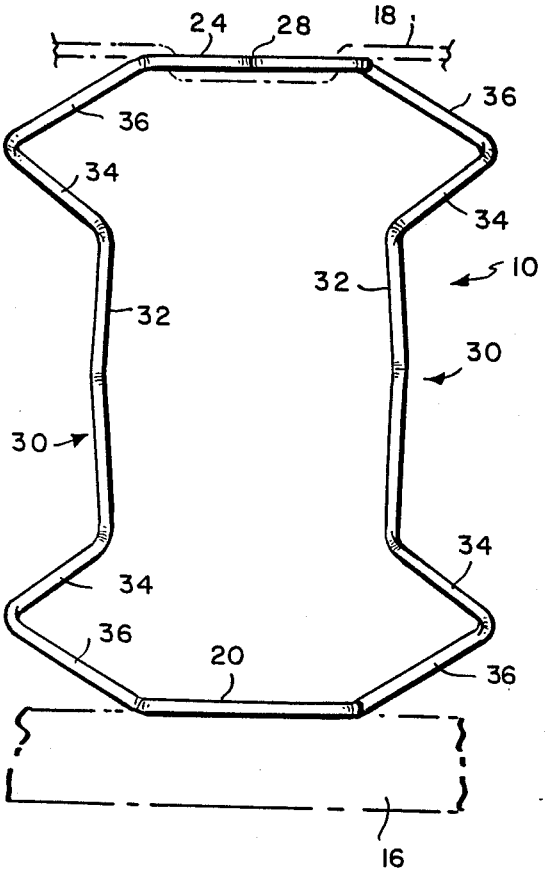
FIG. 4 is a elelvation of FIG. 3.
Figure 5:
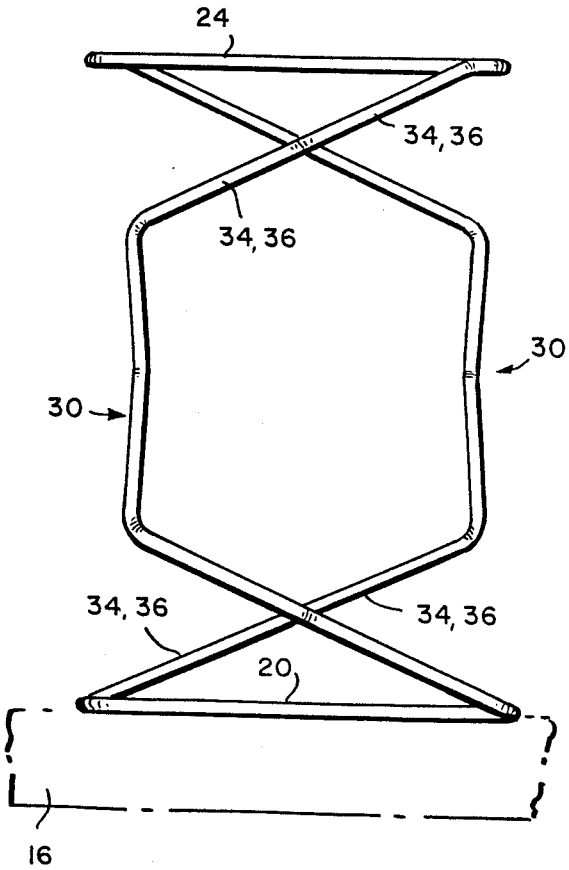
FIG. 5 is an elevation at right angles to FIG. 4.

The lower and upper attaching elements 20—20 and 24—24 are yieldably connected to each other by symmetrically structured supporting legs 30—30, FIGS. 4 and 5. Each leg 30 comprises a vertical length of wire 32. At the opposite ends of the legs 30—30, there are oppositely-diverging legs 34—34. The vertical and diverging lengths of wire 32—32 and 34—34 are disposed in vertical, spaced, parallel planes. At the upper and lower ends of the diverging lengths of wire 34—34, there are upwardly and downwardly-inclined lengths of wire 36—36 extending transversely with respect to the legs 30—30 at obtuse angles to the legs 34—34. As thus structured in plan view, FIGS. 3 and 6, the lengths of wire 24—24, 34—34 and 36—36 are symmetrically disposed about the vertical axis of the module. The upper and lower ends of the respective legs 36—36 are connected to the attaching elements 20—20 and 24—24.

The vertical lengths of wire 32—32 and the inclined first and second lengths of wire 34—34 and 36—36 are disposed symmetrically about the vertical axis of the module such that pressure applied to the upper ends of the modules is supported symmetrically about the vertical axis of the modules.

The vertical lengths of wire 32—32 may optionally be rectilinear or may be bent at obtuse angles in oppositedirections relative to each other.

It should be understood that the present disclosure is for the purpose of illustration only and includes all modifications or improvements which fall within the scope of the appended claims.

What is claimed is:

1. A spring module for disposition between a supporting frame and a grid frame to yieldably support the latter relative to the supporting frame comprising spaced top and bottom attaching means structured to be attached to the supporting frame and the the grid frame, respectively, and supports yeildably connecting the top and bottom attaching elements, said supports comprising vertically-disposed, spaced, parallel lengths of wire, first diverging lengths of wire connected at one end to, respectively, the upper and lower ends of said vertically-disposed, spaced, parallel lengths of wire, said spaced, parallel lengths of wire and said first diverging lengths of wire being situated in spaced, parallel planes perpendicular to the top and bottom attaching elements second diverging lengths of wire connected at one end to the opposite ends of the first diverging lengths of wire and extending from said opposite ends in opposite directions and connected at the opposite ends to the top and bottom attaching elements, said diverging lengths of wire being inclined in opposite directions, and being situated in planes disposed at obtuse angles to the planes of the first diverging lengths of wire.

2. A spring module according to claim 1 wherein the first diverging lengths of wire are disposed at obtuse angles with respect to the ends of the spaced, parallel lengths of wire.

3. a spring module according to claim 1 wherein the second diverging lengths of wire are disposed in planes which are obtuse to the planes of the first diverging lengths of wire.

4. A spring module according to claim 1 wherein the top and bottom attaching elements comprise spaced, parallel lengths of wire occupying spaced, parallel, horizontal planes, and wherein said second lengths of wire are connected at one end to the one end of the attaching elements and horizontal diagonal lengths of wires connecting the other ends of said attaching elements.

5. A spring module according to claim 1 wherein said vertically-disposed lengths of wire and said first and second inclined lengths of wire are disposed symmetrically about the vertical axis of the spring module.

6. A spring module according to claim 1 wherein said second lengths of wire are inclined in opposite directions with respect to the diagonal lengths of wire, that is, downwardly with respect to the upper diagonal lengths of wire and upwardly with respect to the lower diagonal wire.

7. A spring module according to claim 1 wherein the top attaching element comprises spaced, parallel lengths of wire containing deviations.

8. A spring module according to claim 1 wherein the vertically-disposed lengths of wire contain deviations intermediate the opposite ends, said deviations facing in opposite directions.

9. A bent wire spring module comprising transversely-spaced, parallel, vertically-disposed first legs situated between the top and bottom attaching means, oppositely-diverging second legs at the upper and lower ends of the first legs, said first and second legs being situated in spaced, parallel planes perpendicular to the top and bottom attaching means, and third legs at the distal ends of the second legs disposed in perpendicular planes obtuse to the planes of the first and second legs, said third legs being connected at their distal ends to the top and bottom attaching means.

10. A bent wire spring module according to claim 9 wherein said second legs are disposed in opposite directions with respect to the first legs.

11. A bent wire spring module according to claim 9 wherein said second legs at the ends of the first legs are disposed in opposite directions relative to each other.

12. A bent wire spring module according to claim 9 wherein said second legs at the upper and lower ends of the first legs are inclined in opposite directions.

13. A bent wire spring modules according to claim 9 wherein said third legs at the upper and lower ends of the second legs are inclined in opposite directions.

14. A bent wire spring module according to claim 9 wherein the second legs are disposed at obtuse angles relative to the first legs.

15. A bent wire spring module according to claim 9 wherein the third legs are disposed at obtuse angles relative to the second legs.

16. A bent wire spring module according to claim 9 wherein said second legs are inclined in opposite directions with respect to the ends of the first legs and the third legs are inclined in opposite directions with respect to the ends of the second legs.

17. A bent wire spring module according to claim 9 wherein the upper and lower ends of the module comprise spaced, parallel lengths of wire defining spaced, parallel planes and the third legs are inclined with respect to said planes.

18. A bent wire spring module according to claim 9 wherein the third legs are connected to one end of the spaced, parallel lengths of wire and diagonal lengths of wire connect the other ends of the spaced, parallel lengths of wire.

19. A bent wire spring module according to claim 9 wherein the diagonal lengths of wire of the upper and lower attaching elements are parallel.

20. A bent wire spring module comprising a bottom structure, a top structure, each comprising spaced, parallel lengths of wire joined by a diagonal length of wire in the same plane as the parallel lengths of wire and means connecting the bottom and top structures to each other comprising spaced, parallel, vertical lengths of wire, first oppositely-inclined diverging lengths of wire connected at one end to the opposite ends of the vertical lengths of wire and second oppositely-inclined diverging lengths of wire connected at one end to the first oppositely-inclined diverging lengths of wire and at their opposite ends to the bottom and top structure, and wherein said second lengths of wire are at obtuse angles to the vertical lengths of wire and the thrid lengths of wire at oblique angles to the second lengths of wire and wherein the diagonal lengths of wire are at acute angles to the parallel lengths of wire.

21. A bent wire spring module comprising a bottom structure, comprising spaced, parallel lengths of wire and a diagonal length of wire joining the opposite ends of the spaced, parallel lengths of wire, upward, oppositely-inclined second lengths of wire at the opposite ends of the spaced, parallel lengths of wire, upwardly oppositely-inclined third lengths of wire at the upper ends of the second lengths of wire disposed at obtuse angles to the second lengths of wire, spaced, parallel, vertical lengths of wire at the upper ends of the third lengths of wire, upwardly-inclined fourth lengths of wire at the upper ends of the vertical lengths of wire, fifth upwardly-inclined lengths of wire at the upper ends of the fourth lengths of wire, said fifth lengths of wire being connected to the top structure and said top structure comprising spaced, parallel lengths of wire and a diagonal length of wire joining the opposite ends of the spaced, parallel lengths of wire.

* * * * *